US005434597A

United States Patent [19]

Muranaka et al.

[11] Patent Number: 5,434,597

[45] Date of Patent: Jul. 18, 1995

[54] THERMAL TRANSFER RECORDER

[75] Inventors: Masakazu Muranaka, Tokyo; Rie Ishii, Soka, both of Japan

[73] Assignee: Ricoh Company, Ltd., Tokyo, Japan

[21] Appl. No.: 150,814

[22] Filed: Nov. 12, 1993

[30] Foreign Application Priority Data

Nov. 12, 1992 [JP] Japan ..... 4-327298
Jun. 26, 1993 [JP] Japan ..... 5-180006

[51] Int. Cl.[6] ..... B41J 2/325
[52] U.S. Cl. ..... 347/178; 400/237
[58] Field of Search ..... 346/76 PH; 400/237, 400/120

[56] References Cited

U.S. PATENT DOCUMENTS 5,259,680 11/1993 Shimizu et al. ..... 400/237

FOREIGN PATENT DOCUMENTS 0154193 12/1980 Japan ..... 400/237
0242090 12/1985 Japan ..... 400/237
0049472 3/1988 Japan ..... 400/237
0005879 1/1989 Japan ..... 400/237

*Primary Examiner*—Huan H. Tran
*Attorney, Agent, or Firm*—Oblon, Spivak, McClelland, Maier & Neustadt

[57] ABSTRACT

In a color thermal transfer recorder, L is set to a distance from a printing position to first and second sensors for detecting each of marks, q is set to a pitch between the marks, N is set to an integer equal to 2 or more, S is set to an arbitrary value from zero to the pitch q, and δ is set to an arbitrary value from 0 to 4 mm. The values L, q, N, S and δ are set such that the following formula $L=N\times q+S+\delta$ is satisfied. The values L, q, N, S and δ may be set such that the following formula $L=N\times q+S-\delta$ is satisfied. In this recorder, various kinds of marks are formed on an ink sheet and are detected by the first and second sensors so that a conveying operation of the ink sheet is controlled. In accordance with this structure of the recorder, the distance from the printing position to the first and second sensors is increased so that a degree of freedom in design of the recorder is increased.

8 Claims, 13 Drawing Sheets

THERMAL TRANSFER RECORDER

BACKGROUND OF THE INVENTION

1. Field of the invention

The present invention relates to a color thermal transfer recorder in which many heating elements in a thermal head are selectively heated and a color image is formed on a sheet of image receiving paper while an ink sheet and the image receiving paper sheet are supported between the thermal head and a platen and the ink sheet is conveyed at a speed lower than that of the image receiving paper sheet.

2. Description of the Related Art

In a well-known color thermal transfer recorder, an image is generally printed on a sheet of image receiving paper while an ink sheet is conveyed at a speed lower than that of the image receiving paper sheet. In such a recorder, a using amount of the ink sheet can be reduced so that running cost of the recorder can be reduced.

For example, the color thermal transfer recorder of this kind is shown in Japanese Patent Application Laying Open (KOKAI) No. 61-242869. In this patent application, a plurality of ink layers are arranged in the longitudinal direction of an ink sheet and have colors different from each other. The plural ink layers are set to one set of color groups. The ink sheet is used by repeatedly forming the color groups in the longitudinal direction. When an image is printed, this ink sheet is conveyed in its longitudinal direction and ink of each of the ink layers of each of the color groups formed in the ink sheet is transferred onto a sheet of image receiving paper. Thus, a color image is recorded on the image receiving paper sheet.

In this case, the ink sheet has a leading color mark, a heading mark and a terminal end mark. The leading color mark is formed to detect that a leading end region of each of the color groups reaches a printing position between a heating element of a thermal head and a platen. The heading mark is formed to detect that a leading end region of an ink layer of each of colors except for a leading ink layer of each of the color groups reaches the printing position. The terminal end mark is formed to detect a terminal end of the ink sheet. These marks are detected by a detecting means constructed by first and second sensors so that conveyance of the ink sheet is controlled.

The above first and second sensors are generally arranged in predetermined positions in the vicinity of the printing position such that each of the marks can be reliably detected.

As described later, such arranging positions of the first and second sensors are determined in accordance with a pitch between the ink layers in a conveying direction of the ink sheet. It is generally considered that the positions of the first and second sensors must be set to approach the pointing position as this pitch is reduced.

As mentioned above, the ink sheet is conveyed at a speed lower than that of the image receiving paper sheet in the color thermal transfer recorder. In this recorder, a conveying amount of the ink sheet is smaller than that of the image receiving paper sheet. Accordingly, the pitch between the ink layers is reduced in comparison with a recorder in which the ink sheet and the image receiving paper sheet are conveyed at an equal speed. Since the pitch between the ink layers is small, the first and second sensors must be generally arranged very near the printing position for the above reasons.

However, various kinds of constructional elements such as the thermal head, the platen, etc. are arranged in a region near the printing position. Accordingly, it is not easy to arrange the first and second sensors in such a region. Therefore, a degree of freedom in design of the recorder is greatly restricted.

SUMMARY OF THE INVENTION

It is therefore an object of the present invention to provide a color thermal transfer recorder in which first and second sensors can be arranged in positions greatly separated from a printing position without any problems.

The above object can be achieved by a color thermal transfer recorder in which a plurality of ink layers having colors different from each other are arranged in a longitudinal direction of an ink sheet and are set to one set of color groups and the ink sheet is used by repeatedly forming the color groups in the longitudinal direction;

many heating elements of a thermal head are selectively heated while the ink sheet and a sheet of image receiving paper are supported between the thermal head and a platen and the ink sheet is conveyed in the longitudinal direction thereof at a speed lower than that of the image receiving paper sheet;

a color image is formed on the image receiving paper sheet by transferring ink of each of the ink layers of each of the color groups formed in the ink sheet onto the image receiving paper sheet;

the ink sheet has:

a leading color mark for detecting that a leading end region of each of the color groups reaches a printing position between the heating elements and the platen;

a heading mark for detecting that a leading end region of each of the color ink layers except for a reading ink layer of each of the color groups reaches the printing position; and a terminal end mark for detecting a terminal end of the ink sheet;

each of the marks is detected by detecting means constructed by first and second sensors;

the first and second sensors are arranged on a downstream side of the ink sheet in a conveying direction thereof from the printing position; and when L is set to a distance from the printing position to each of the first and second sensors, q is set to a pitch between the marks, N is set to an integer equal to 2 or more, S is set to an arbitrary value from zero to the pitch q, and $\delta$ is set to an arbitrary value from 0 to 4 mm, the values L, q, N, S and $\delta$ are set such that the following formula $$L=N\times q+S+\delta$$

is satisfied.

The above object can be also achieved by a color thermal transfer recorder in which a plurality of ink layers having colors different from each other are arranged in a longitudinal direction of an ink sheet and are set to one set of color groups and-the ink sheet is used by repeatedly forming the color groups in the longitudinal direction;

many heating elements of a thermal head are selectively heated while the ink sheet and a sheet of image receiving paper are supported between the thermal head and a platen and the ink sheet is conveyed in the longitudinal direction thereof at a speed lower than that of the image receiving paper sheet;

a color image is formed on the image receiving paper sheet by transferring ink of each of the ink layers of each of the color groups formed in the ink sheet onto the image receiving paper sheet;

the ink sheet has:

a leading color mark for detecting that a leading end region of each of the color groups reaches a printing position between the heating elements and the platen;

a heading mark for detecting that a leading end region of each of the color ink layers except for a leading ink layer of each of the color groups reaches the printing position; and a terminal end mark for detecting a terminal end of the ink sheet;

each of the marks is detected by detecting means constructed by first and second sensors;

the first and second sensors are arranged on an upstream side of the ink sheet in a conveying direction thereof from the printing position; and when L is set to a distance from the printing position to each of the first and second sensors, q is set to a pitch between the marks, N is set an integer equal to 2 or more, S is set to an arbitrary value from zero to the pitch q, and $\delta$ is set to an arbitrary value from 0 to 4 mm, the values L, q, N, S and $\delta$ are set such that the following formula $$L=N\times q+S-\delta$$

is satisfied.

In each of the above color thermal transfer recorders, the detecting means preferably has at least one auxiliary sensor in addition to the first and second sensors to detect that a leading end region of an ink layer of any color reaches the printing position. Further, an auxiliary mark detected by the auxiliary sensor is preferably formed on the ink sheet.

In each of the-above color thermal transfer recorders, a distance from the printing position to the auxiliary sensor is desirably set to be equal to or greater than a distance from the printing position to the first and second sensors.

Each of the above color thermal transfer recorders is preferably constructed such that the leading end region of each of the color groups is judged to reach the printing position, the leading end region of each of the color ink layers except for the leading ink layer of each of the color groups is judged to reach the printing position, or the terminal end of the ink sheet is judged according to whether one sensor detects one mark and another sensor then detects another mark after a predetermined time.

In accordance with the above color thermal transfer recorders, the first and second sensors can be arranged in positions greatly separated from the printing position without any problems.

Further objects and advantages of the present invention will be apparent from the following description of the preferred embodiments of the present invention as illustrated in the accompanying drawings.

DESCRIPTION OF THE PREFERRED EMBODIMENTS

The preferred embodiments of a color thermal transfer recorder in the present invention will next be described in detail with reference to the accompanying drawings.

Figure 1:
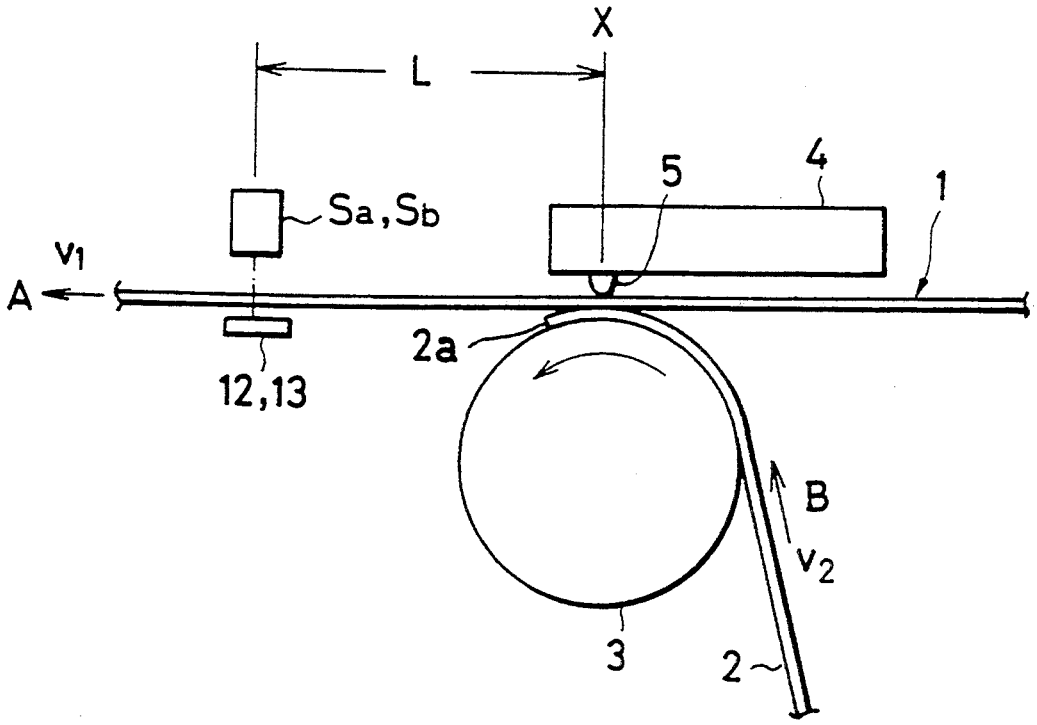
FIG. 1 is a view for schematically explaining a color thermal transfer recorder in accordance with one embodiment of the present invention.
Figure 2:
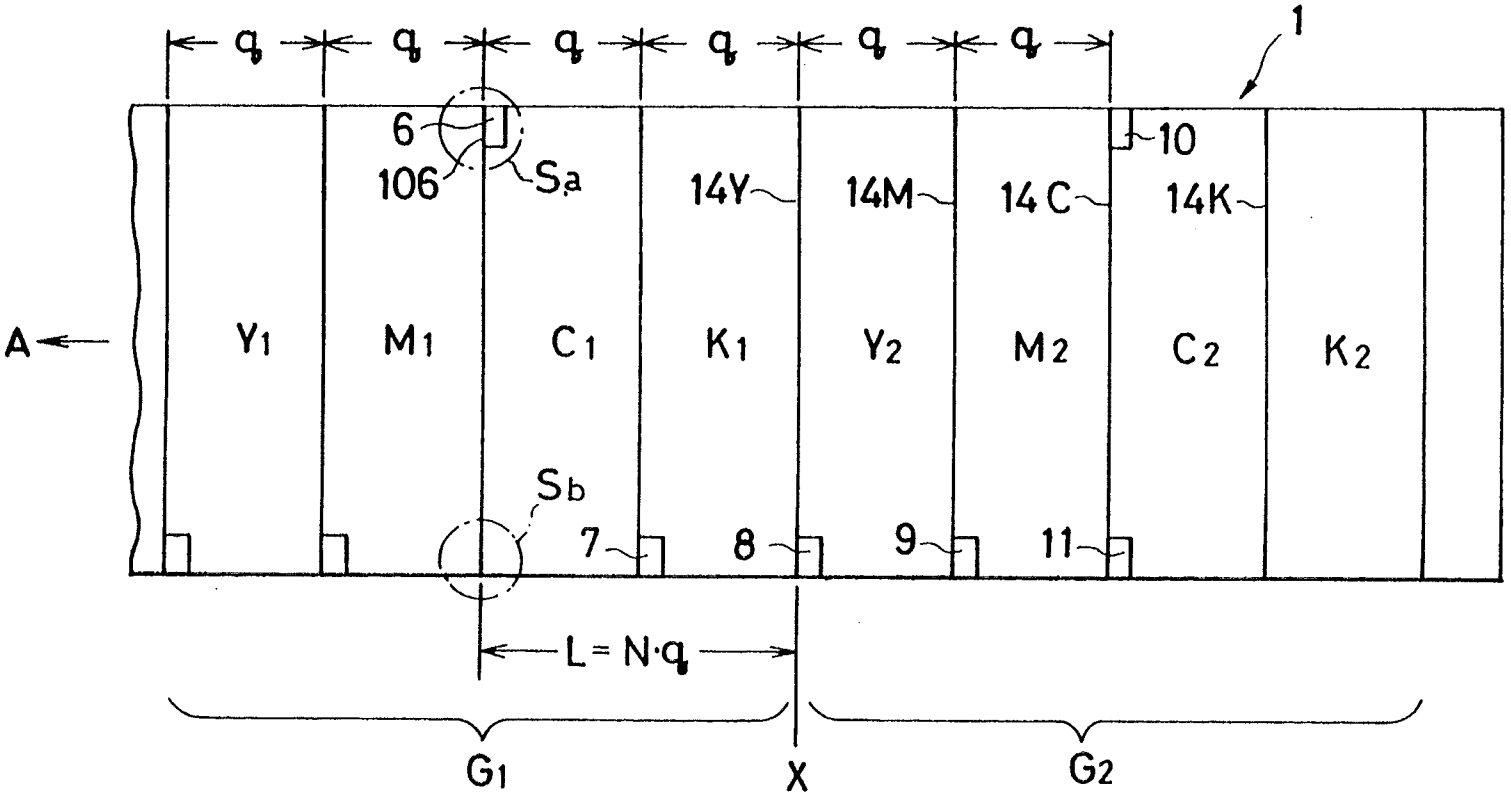
FIG. 2 is a plan view for explaining the relation between an ink sheet and sensors.

FIG. 1 is an explanatory view schematically showing a color thermal transfer recorder in accordance with one embodiment of the present invention. FIG. 2 is a plan view showing one example of an ink sheet used in this recorder.

Many ink layers are arranged in a longitudinal direction of the ink sheet 1 shown in FIG. 2. The ink layers are coated and formed on a base sheet. In this case, plural ink layers arranged in the longitudinal direction of the ink sheet 1 have colors different from each other and constitute one set of color groups. Such color groups are numerously and repeatedly formed in the longitudinal direction of the ink sheet 1.

FIG. 2 shows two color groups $G_1$ and $G_2$. Each of the color groups $G_1$ and $G_2$ has a yellow ink layer shown by $Y_1$ and $Y_2$, a magenta ink layer shown by $M_1$ and $M_2$, a cyan ink layer shown by $C_1$ and $C_2$, and a black ink layer shown by $K_1$ and $K_2$. The four color ink layers composed of the yellow, magenta, cyan and black ink layers in each of the color groups $G_1$ and $G_2$ are arranged in the same color order in the longitudinal direction of the ink sheet 1. Such color groups are numerously arranged in the longitudinal direction of the ink sheet 1. FIG. 2 shows two color groups $G_1$ and $G_2$ among these color groups. In the example shown in FIG. 2, the color group $G_2$ is set to a final color group of the ink sheet 1.

Each of the color groups may be constructed by yellow, magenta and cyan ink layers without using the black ink layers $K_1$ and $K_2$.

As shown in FIG. 1, the above ink sheet 1 and a sheet 2 of image receiving paper are supported between a platen 3 and a thermal head 4. In this supporting state, the ink sheet 1 is conveyed in the direction of an arrow A. In contrast to this, the image receiving paper sheet 2 are wound around a portion of the platen 3 and is conveyed in the direction of an arrow B by rotating the platen 3 in the counterclockwise direction. At this time, the ink sheet 1 is conveyed at a speed lower than that of the image receiving paper sheet 2 in a longitudinal direction of the ink sheet 1. When the conveying speed of the ink sheet 1 is set to $v_1$ and the conveying speed of the image receiving paper sheet 2 is set to $v_2$, the ink sheet 1 and the image receiving paper sheet 2 are conveyed in the relation of $v_1=v_2/n$ $(n>1)$.

As mentioned above, when the ink sheet 1 and the image receiving paper sheet 2 are conveyed, many heating elements 5 in the thermal head 4 are selectively heated in accordance with a picture signal. Ink of each of the ink layers of each of the color groups formed in the ink sheet 1 is melted or sublimated by heat of each of the heating elements 5 and is transferred onto the image receiving paper sheet 2. Thus, a color image is formed on the image receiving paper sheet 2. The ink is printed on the image receiving paper sheet 2 in a position of each of the heating elements 5 of the thermal head 4. This position of each of the heating elements 5 is set to a printing position X.

When the ink is generally melted as mentioned above, this ink is constructed by pigments. In contrast to this, when the ink is sublimated, this ink is constructed by dyes.

As shown in FIG. 2, various kinds of marks are formed every color group in an end region of the ink sheet 1 in a width direction thereof so as to control a conveying operation of the ink sheet 1 as described later. For example, in the case of the color group $G_2$, a leading color mark 6 and heading marks 7, 8, 9 are formed on the ink sheet 1 in association with this color group $G_2$. These marks are similarly formed with respect to each of the other color groups.

The leading color mark 6 in each of the color groups is formed to detect that a leading end region of each of the color groups reaches the printing position X between a heating element 5 and the platen 3. The heading marks 7, 8 and 9 in each of the color groups are formed to detect that a leading end region of each of the color ink layers except for a leading ink layer in each of the color groups reaches the printing position X. In this embodiment, this leading ink layer is set to the yellow ink layer.

In this embodiment, the color group $G_2$ of the ink sheet 1 is set to a final color group for finally performing a printing operation. This color group $G_2$ has terminal end marks 10 and 11 for detecting a terminal end of the ink sheet 1. Such terminal end marks 10 and 11 are not formed in the color groups except for the final color group such as $G_2$.

The recorder shown in FIGS. 1 and 2 has a detecting means constructed by a first sensor $S_a$ and a second sensor $S_b$ for detecting each of the above-mentioned marks. In this embodiment, these sensors $S_a$ and $S_b$ are fixedly arranged on a downstream side of the ink sheet in a conveying direction thereof from the printing position X.

Each of the first sensor $S_a$ and the second sensor $S_b$ is illustrated as one example in FIGS. 1 and 2 and is constructed by a photosensor of a reflecting type. As shown in FIG. 1, reflecting plates 12 and 13 are fixedly arranged in positions opposite to the respective sensors $S_a$ and $S_b$ in a state in which the ink sheet 1 is located between the reflecting plates 12, 13 and the sensors $S_a$ and $S_b$.

An entire face of the ink sheet 1 shown in FIG. 2 except for regions of the above-mentioned marks is coated with ink. Light is transmitted through only an uncoated portion of each of the marks in which no ink sheet is coated with ink. Accordingly, when each of the marks reaches a position below each of the sensors $S_a$ and $S_b$, light emitted from a light emitting element of each of the sensors $S_a$ and $S_b$ is transmitted through each of the marks and is reflected on each of the reflecting plates 12 and 13. The reflected light is again transmitted through each of the marks and is incident to a light receiving element of each of the sensors $S_a$ and $S_b$ so that each of the marks is detected.

The relative constructions of the marks and the sensors will next be clearly described while the above printing operation and various kinds of operations relative to the printing operation are explained in detail.

For example, a color image is formed on the image receiving paper sheet 2 by each of the ink layers $Y_2$, $M_2$, $C_2$ and $K_2$ in the final color group shown by $G_2$ in FIG. 2. As shown in FIG. 1, the image receiving paper sheet 2 is first conveyed toward the printing position X from an unillustrated paper supplying portion in the direction of an arrow B. An operation of the platen 3 is stopped when a leading end 2*a* of the image receiving paper sheet 2 has reached the printing position X or a starting position shown in FIG. 1 and slightly passing through the printing position X. Thus, the image receiving paper sheet 2 is stopped in this position.

Figure 3:
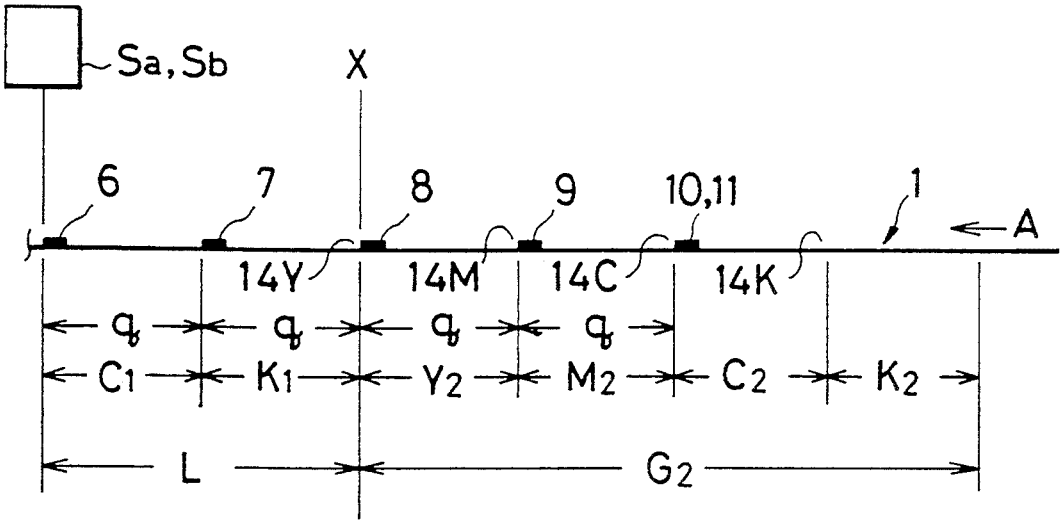
FIG. 3 is an explanatory view showing the relation between respective marks and the sensors.

In contrast to this, as shown in FIGS. 2 and 3, the leading color mark 6 of the ink sheet 1 is detected by the first sensor $S_a$ and is stopped in a position shown in each of FIGS. 2 and 3 by a detecting signal of the first sensor $S_a$. At this time, a leading end region of the color group $G_2$ is located in the printing position X. In this embodiment, a most leading end 14Y of this color group $G_2$ is located in the printing position X. This most leading end 14Y is also equal to a most leading end of the yellow ink layer $Y_2$. Thus, when the first sensor $S_a$ detects the leading color mark 6, it is detected that the leading end region of the color group $G_2$ has reached the printing position X. When the ink sheet 1 and the image receiving paper sheet 2 are conveyed as mentioned above, the thermal head 4 is escaped upward from a position thereof shown in FIG. 1.

When the first sensor $S_a$ detects the leading color mark 6 as mentioned above, the thermal head 4 is towered to the position shown in FIG. 1. Then, the ink sheet 1 and the image receiving paper sheet 2 are supported by the thermal head 4 and the platen 3 therebetween.

When such a preparing operation is completely performed, the platen 3 is rotated in the counterclockwise direction in FIG. 1 so that the image receiving paper sheet 2 and the ink sheet 1 are respectively conveyed in the directions of arrows B and A. At this time, as mentioned above, ink of a leading ink layer in the color group $G_2$ is transferred onto the image receiving paper sheet 2. In this embodiment, ink of the yellow ink layer $Y_2$ is transferred onto the image receiving paper sheet 2. Thus, a yellow image is formed on the image receiving paper sheet 2.

Thus, the printing operation with respect to the yellow ink layer $Y_2$ is performed. After this printing operation is completely performed, the thermal head 4 is again raised and the platen 3 is rotated in the clockwise direction. Thus, the image receiving paper sheet 2 is conveyed in a direction opposite to the arrow B. The platen 3 is stopped in a position in which the leading end 2*a* of the image receiving paper sheet 2 is returned to the starting position shown in FIG. 1. The image receiving paper sheet 2 is stopped in this starting position.

When the heading mark 7 of the ink sheet 1 conveyed in the direction of the arrow A is detected by the second sensor $S_b$, the ink sheet 1 is stopped by a detecting signal of this second sensor $S_b$. At this time, a leading end region of a second ink layer in the color group $G_2$ has reached the printing position X. In this embodiment, a most leading end 14M of the magenta ink layer $M_2$ has reached the printing position X.

Similar to the printing operation with respect to the yellow ink layer $Y_2$, the printing operation with respect to the magenta ink layer $M_2$ is next performed. Thus, a magenta image is formed on the image receiving paper sheet 2 in a state in which the yellow and magenta images overlap each other.

When the printing operation with respect to the magenta ink layer is completely performed, the thermal head 4 is escaped upward as in the above case and the image receiving paper sheet 2 is returned to the starting position. Then, the heading mark 8 for the next cyan ink layer $C_2$ is detected by the second sensor $S_b$. The ink sheet 1 is stopped by a detecting signal of this second sensor $S_b$. At this time, a leading end region of the cyan ink layer $C_2$ has reached the printing position X. In this embodiment, a most leading end 14C of the cyan-ink layer $C_2$ has reached the printing position X. Subsequently, the printing operation with respect to the cyan ink layer $C_2$ is performed.

Similar to the above case, when this printing operation is completely performed, the image receiving paper sheet 2 is returned to the starting position. Then, the heading mark 9 for the black ink layer $K_2$ is detected by the second sensor $S_b$. At this time, a leading end region of the black ink layer $K_2$ has reached the printing position X. In this embodiment, a most leading end 14K of the black ink layer $K_2$ has reached the printing position X. The ink sheet 1 is stopped in this state. Subsequently, the printing operation with respect to the black ink layer $K_2$ is performed. Thus, a color image composed of plural ink colors is formed on the image receiving paper sheet 2.

When the printing operation with respect to the final black ink layer $K_2$ is completely performed, the thermal head 4 is raised and the image receiving paper sheet 2 forming the color image thereon is conveyed in the direction of the arrow B. The image receiving paper sheet 2 is then discharged to an unillustrated paper discharging section.

When no color group is equal to the final color group $G_2$, a leading color mark of the next color group is detected by the first sensor $S_a$ and the ink sheet 1 is stopped. Subsequently, a series of the above-mentioned operations is performed. Thus, a color image is formed on the next image receiving paper sheet. As shown in this embodiment, when the printing operation with respect to the final color group $G_2$ is performed, the terminal end marks 10 and 11 are detected by the first and second sensors $S_a$ and $S_b$ after the printing operation with respect to the final black ink layer $K_2$ has completely performed. A display section additionally arranged in a recorder body then displays that the ink sheet 1 should be replaced with a new one. For example, the display section displays these contents on the basis of detecting signals of the first and second sensors $S_a$ and $S_b$ by commands from an unillustrated controller including a central processing unit (CPU). An operator replaces the ink sheet with another in accordance with this display.

Figure 4:
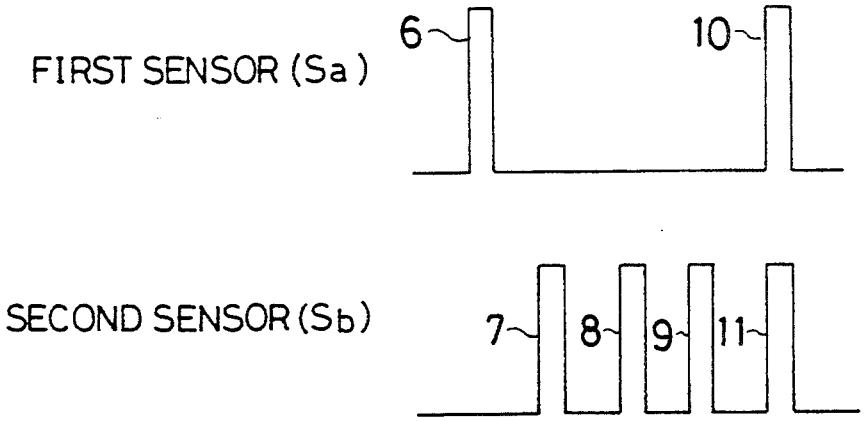
FIG. 4 is a timing chart showing operational timings of the sensors shown in FIGS. 1 to 3.

In the above example, the leading color mark 6 is formed on one end side of the ink sheet 1 in a width direction thereof. This leading color mark 6 is detected by the first sensor $S_a$. Each of the heading marks 7, 8 and 9 is formed on the other end side of the ink sheet 1 in the width direction. Each of the heading marks 7, 8 and 9 is detected by the second sensor $S_b$. Each of the two terminal end marks 10 and 11 is formed on each of the end sides of the ink sheet 1 in the width direction. The terminal end marks 10 and 11 are detected by the first and second sensors $S_a$ and $S_b$. FIG. 4 shows operating states of the sensors $S_a$ and $S_b$ at this time. The controller judges each of these marks by differences between combinations of detecting states of the sensors $S_a$ and $S_b$. However, in this example, no controller can judge whether each of the three heading marks 7, 8 and 9 is a mark for an ink layer of any color.

The above combinations of the detecting states can be suitably changed. For example, the leading color mark may be constructed by two marks and these two marks may be detected by the two sensors $S_a$ and $S_b$. Further, the terminal end marks may be constructed by one mark and this one mark may be detected-by one of the sensors.

In the embodiments shown in FIGS. 1 to 4, it is judged that each of the marks has reached each of the sensors $S_a$ and $S_b$ when each of the sensors $S_a$ and $S_b$ detects a leading end edge of each of the marks 6 to 11 on an upstream side of the ink sheet in the conveying direction thereof. For example, this leading end edge is set to an edge designated by reference numeral 106 in FIG. 2 in the case of the mark 6. As shown in FIG. 4, a mark is detected by rise of a detecting pulse of each of the sensors in the above so-called front edge detection. In this example, the leading end edge of each of the marks is in conformity with each of the most leading ends 14Y, 14M, 14C and 14K of the ink layers.

The marks 6 to 11 and the first and second sensors $S_a$ and $S_b$ function as mentioned above.

In the following description, reference numeral L is set to a distance from the printing position X to each of the sensors $S_a$ and $S_b$. Reference numeral q is set to a pitch of each of the marks. In this case, when each of the marks is detected by each of the sensors $S_a$ and $S_b$ as mentioned above, a most leading end of each of the color groups or a most leading end of each of the ink layers in each of the color groups can reach the printing position X and a terminal end of the ink sheet 1 can be detected as mentioned above by setting the values L and q such that the following first formula is satisfied.

$L=N\times q$ (N is an integer equal to one or more)

The pitch q is equal to a pitch between the ink layers in the conveying direction of the ink sheet 1.

Figure 17:
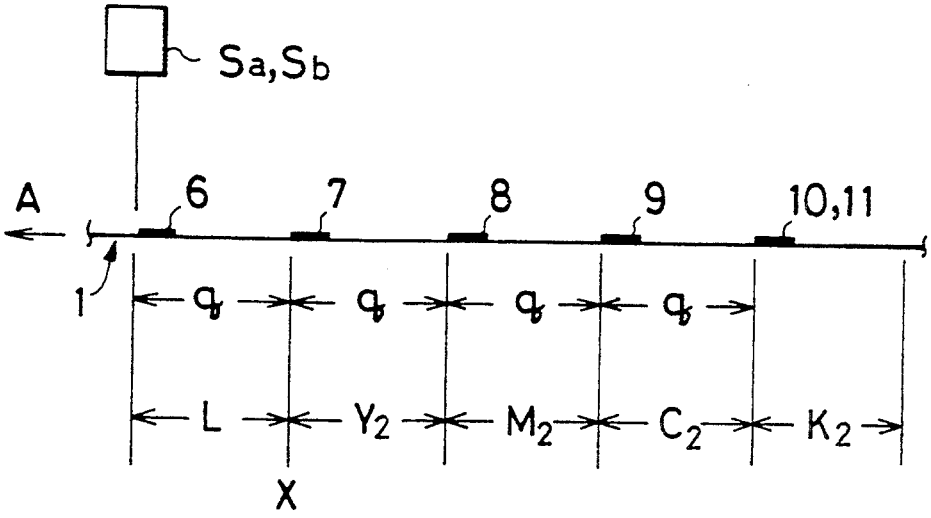
FIG. 17 is a view for explaining a problem that first and second sensors approach a printing position when an integer N is set to 1.

FIG. 17 is an explanatory view similar to FIG. 3 when N=1. As can be seen from FIG. 17, a predetermined color image can be obtained and a terminal end of the ink sheet 1 can be detected by forming each of the marks in a position shown in FIG. 17 while a conveying operation of the ink sheet 1 is controlled as mentioned above even when N=1.

However, in the recorder of the present invention, the printing operation is performed while the ink sheet 1 is conveyed at a speed lower than that of the image receiving paper sheet 2. Therefore, a pitch of each of the ink layers is small so that the pitch q between the marks is very small. Accordingly, when N=1 is set, L=q is formed so that this distance L is also very small. Therefore, each of the sensors $S_a$ and $S_b$ must be located very near the printing position X.

However, as shown in FIG. 1, constructional elements such as the platen 3, the thermal head 4, etc. are arranged in the vicinity of the printing position X. Accordingly, it is not easy to arrange each of the sensors $S_a$ and $S_b$ in the vicinity of the printing position X. Thus, when N =1 is set, a degree of freedom in design of the recorder is greatly restricted.

Therefore, in the present invention, N in the above first formula is first set to an integer equal to 2 or more. Each of FIGS. 2 and 3 shows an example in which N is set to 2. If N is set to an integer equal to 2 or more, the conveying operation of the ink sheet 1 can be correctly controlled. Further, each of the sensors $S_a$ and $S_b$ can be greatly separated from the printing position X so that the degree of freedom in design of the recorder can be greatly increased. In the examples of FIGS. 1 to 3, each of the sensors $S_a$ and $S_b$ is arranged at the distance L twice the pitch q. Accordingly, no sensors interfere with the other constructional elements so that the recorder can be easily designed.

In the embodiments shown in FIGS. 2 to 4, when each of the sensors $S_a$ and $S_b$ detects each of the marks in each of the color groups, the most leading end of each of the color groups and the most leading end of each of the ink layers in each of the color groups are located just in the printing position X. However, when each of the marks is detected by each of the sensors $S_a$ and $S_b$, each of the most leading ends 14Y, 14M, 14C and 14K may be located on a downstream side of the ink sheet in the conveying direction thereof by a slight distance δ from the printing position X.

Figure 5:
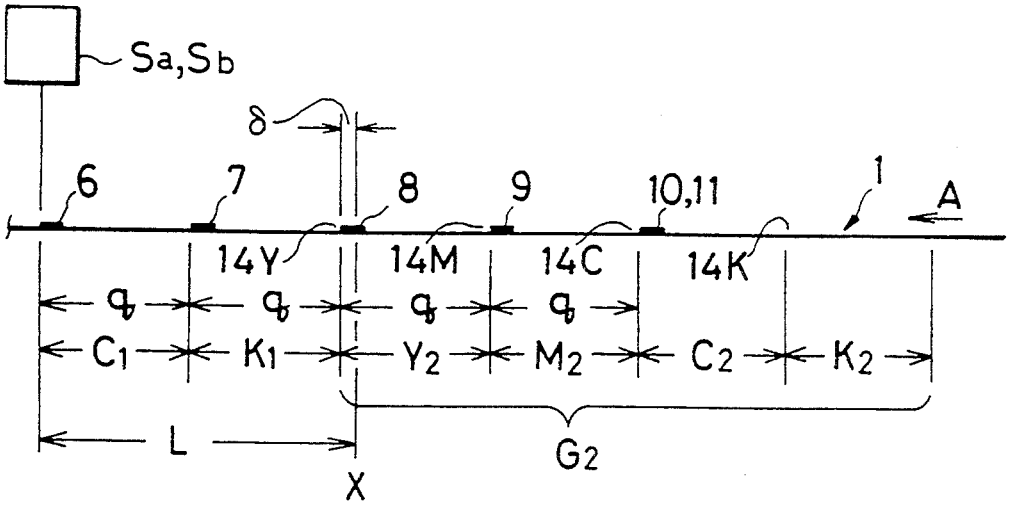
FIG. 5 is an explanatory view similar to FIG. 3 in accordance with another embodiment of the present invention.

In an example shown in FIG. 5, when the leading color mark 6 is detected by the first sensor $s_a$, the most leading end 14Y of the color group $G_2$ is stopped in a state in which this most leading end 14Y is shifted on a side of the sensors $S_a$ and $S_b$ by the distance δ from the printing position X. In this case, when each of the marks is detected by each of the sensors $S_a$ and $S_b$, a leading end region of each of the ink layers can reach the printing position X, or a terminal end of the ink sheet 1 can be detected by setting values L and q such that the following second formula is satisfied.

$$L=N\times q+\delta \text{ (N is an integer equal to 2 or more)}$$

Value L is set to a distance from the printing position X to each of the sensors $S_a$ and $S_b$. Value q is set to a pitch between the marks. In the example shown in FIG. 5, the above leading end region of each of the ink layers is provided by an ink sheet portion on an upstream side of each of the most leading ends 14Y, 14M, 14C and 14K by the distance δ. In this case, each of the first and second sensors $S_a$ and $S_b$ can be also greatly separated from the printing position X by setting N to an integer equal to 2 or more. FIG. 5 shows an example in which N is set to 2.

In this example, no ink layer portion shown by δ is used to perform the printing operation. Accordingly, when the value of δ is excessively large, utilization efficiency of the ink sheet is reduced. Therefore, in the present invention, δ is set to an arbitrary value from 0 to 4 mm ($0\leqq\delta<4$). δ is set to zero in the example shown in each of FIGS. 2 and 3.

As mentioned above, utilization efficiency of the ink sheet can be improved if δ is set to zero. In contrast to this, if δ is set to be greater than zero, it is possible to prevent colors of a completed color image from being mixed with each other. In FIG. 5, for example, when δ is set to zero and the same construction as FIG. 3 is used and the printing operation with respect to the yellow ink layer $Y_2$ is started in the printing position X, there is a fear that ink of the black ink layer $K_1$ adjacent to the yellow ink layer on its left-hand side is also transferred onto the image receiving paper sheet 2. In contrast to this, when δ is set to be greater than zero, occurrence of such a problem can be prevented. Accordingly, it is preferable to set δ to be a larger value. However, when δ is set to be excessively large, utilization efficiency of the ink sheet 1 is reduced as mentioned above. Therefore, in the present invention, δ is set to be ranged from 0 to 4 min.

Figure 6:
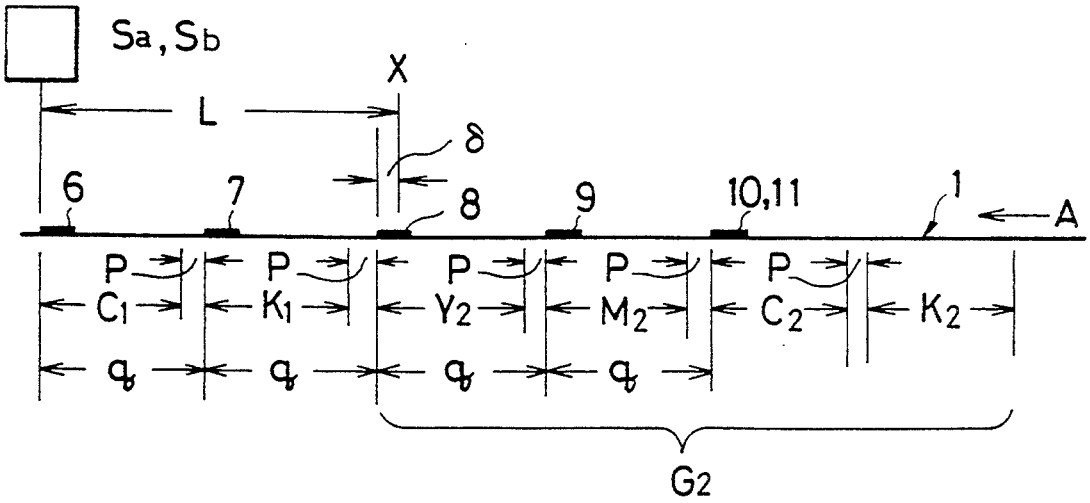
FIG. 6 is an explanatory view similar to FIG. 3 in accordance with another embodiment of the present invention.

In each of the above embodiments, the ink layers are continuously formed without forming clearances therebetween. However, FIG. 6 shows an example of an ink sheet 1 in which clearances P are formed between ink layers and N is set to 2. Similar to the embodiments shown in FIGS. 1 to 5, the above-mentioned second formula can be also satisfied in the example of FIG. 6. In FIG. 6, δ can be also set to an arbitrary value ranged from 0 to 4 mm. In this example, the clearances P are formed between the ink layers even when δ is set to zero. Accordingly, it is possible to prevent colors of a color image from being mixed with each other.

In a general recorder of this kind, a mark is commonly formed in a region of a boundary portion of each of the ink layers. In each of the above embodiments, a leading end edge of each of the marks in a detected position thereof is set to be in conformity with a most leading end of each of the ink layers in accordance with such a general structure. However, in the present invention, as mentioned above, each of the marks can be arranged at a predetermined pitch q in any position of the ink sheet 1 in the longitudinal direction thereof.

Figure 7:
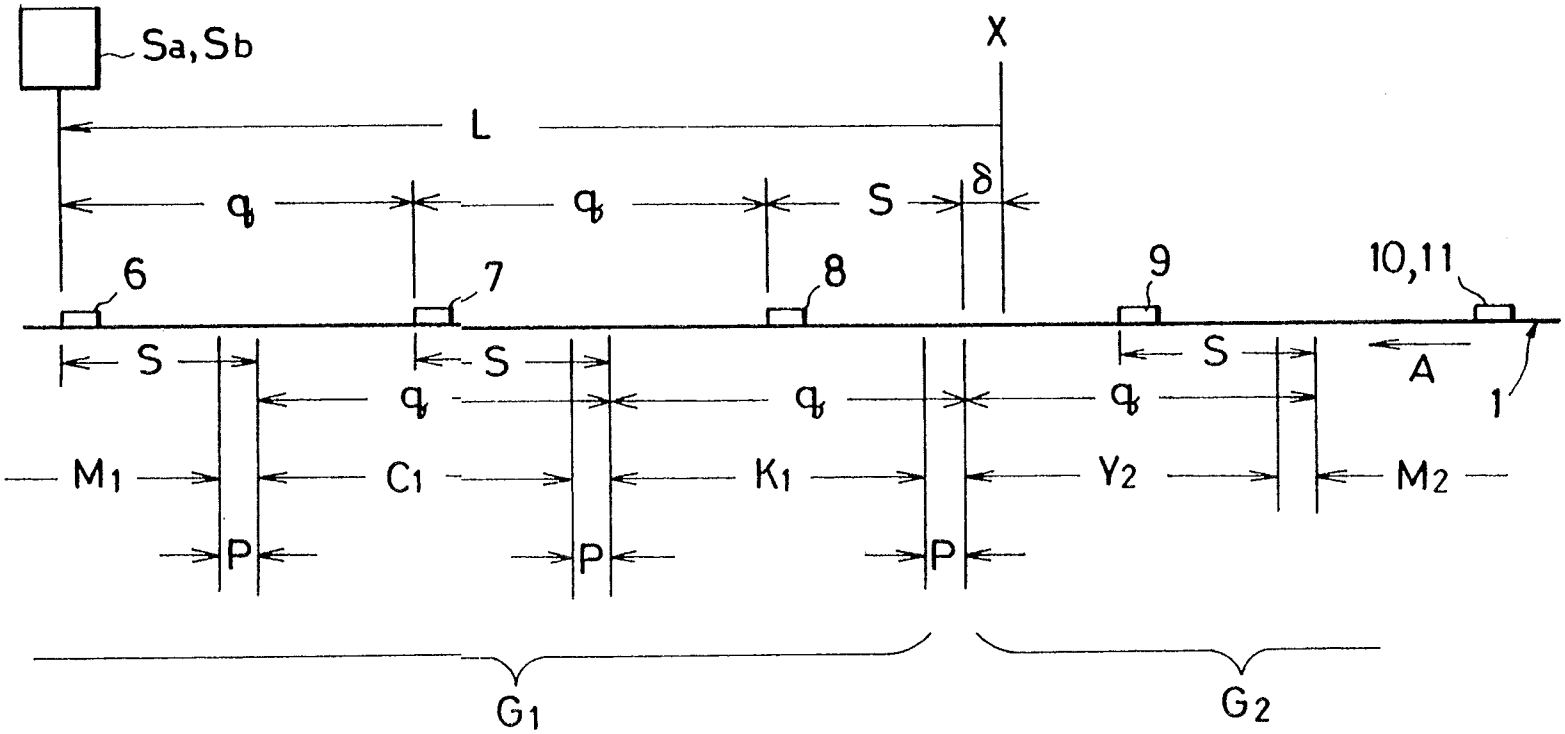
FIG. 7 is an explanatory view similar to FIG. 3 and showing another embodiment of the present invention.

FIG. 7 is an explanatory view showing one example of such an arrangement. Reference numerals designating constructional portions in FIG. 7 correspond to those in FIGS. 1 to 6. In FIG. 7, a leading end edge of each of marks 6 to 11 in a detected position thereof is not set to be in conformity with a most leading end of each of ink layers, but is separated from this most leading end by a distance S.

In such a construction, similar to the above embodiments, when each of the marks is detected by each of sensors $S_a$ and $S_b$, a leading end region of each of the ink layers can reach a printing position X, or a terminal end of the ink sheet 1 can be detected by setting values L, N, q, S and δ such that the following third formula is satisfied.

$$L=N\times q+S+\delta$$

Values L, N, q and S in this third formula are equal to those in the above-mentioned second formula. Namely, N is set to an integer equal to 2 or more. In the example of FIG. 7, N is set to 2. Value q is set to a pitch between the ink layers as a pitch between the marks. δ is set to be ranged from 0 to 4 mm. As mentioned above, S is set to a distance between each of the marks and a most leading end of each of the ink layers. Accordingly, S can be set to an arbitrary value from zero to the pitch q.

The above second formula is provided in a special case of the third formula in which S is set to zero. In the embodiments of FIGS. 2 to 5, the clearances P between the ink layers shown in FIG. 7 are set to zero. In the embodiments of FIGS. 2 and 3, P and δ are set to zero.

The above third formula is a formula showing a general structure of the present invention provided when the first and second sensors $S_a$ and $S_b$ are arranged in positions on a downstream side of the ink sheet in a conveying direction thereof from the printing position. The sensors $S_a$ and $S_b$ can be greatly separated from the printing position by setting N in the third formula to an integer equal to 2 or more.

In the above embodiments, the two sensors $S_a$ and $S_b$ are arranged on the downstream side of the ink sheet in the conveying direction thereof from the printing position X. However, the two sensors $S_a$ and $S_b$ can be arranged on an upstream side of the ink sheet in the conveying direction thereof from the printing position X.

Figure 8:
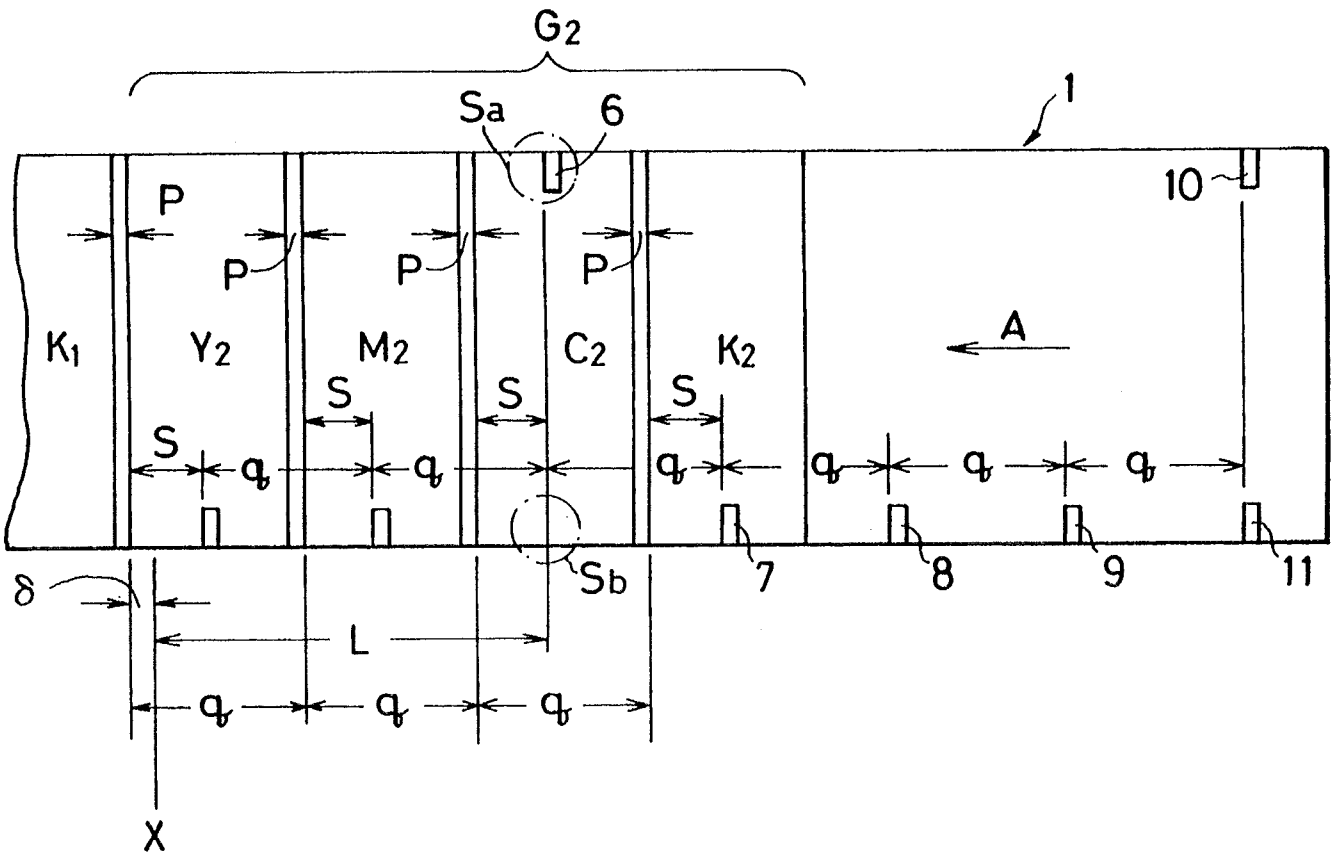
FIG. 8 is a plan view similar to FIG. 2 and showing another embodiment of the present invention.
Figure 9:
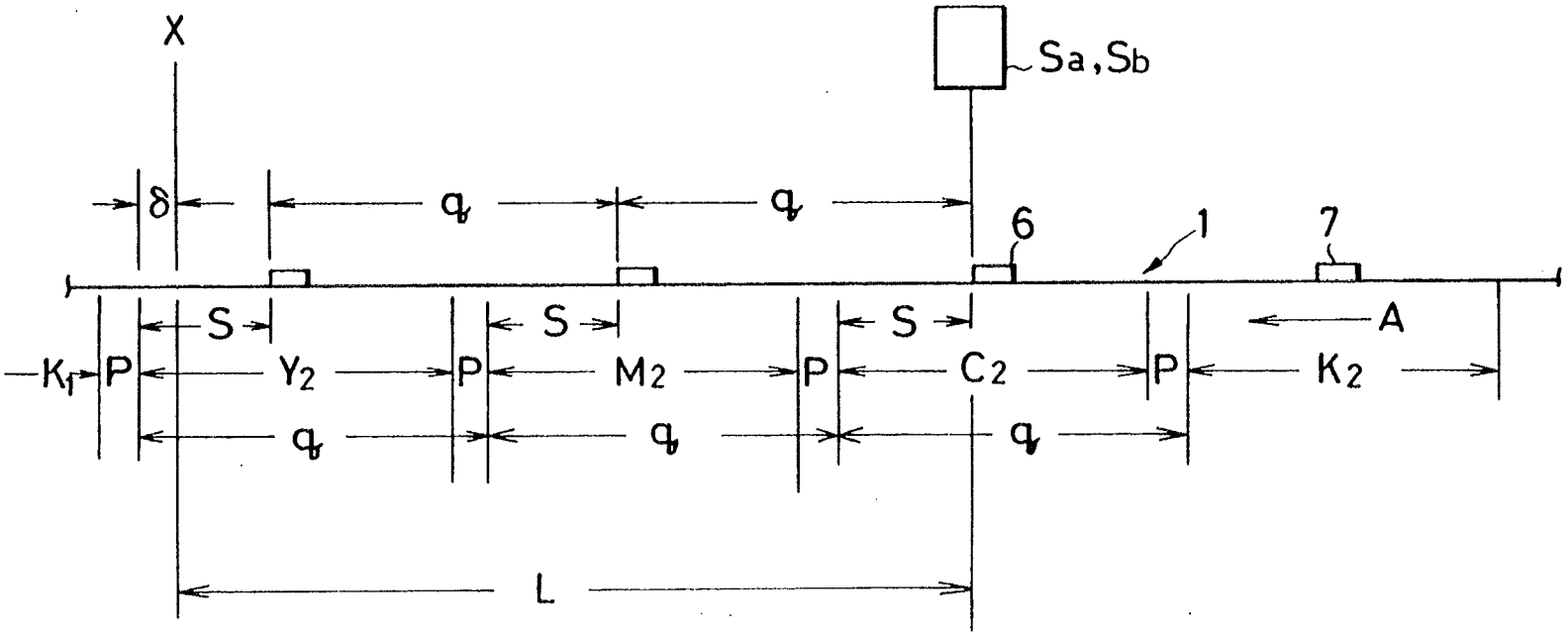
FIG. 9 is an explanatory view similar to FIG. 3 in the embodiment-shown in FIG. 8.

Each of FIGS. 8 and 9 is an explanatory view showing one example of such an arrangement. Reference numerals in FIGS. 8 and 9 correspond to those in each of the above-mentioned embodiments. In a color thermal transfer recorder shown in each of FIGS. 8 and 9, similar to each of the above embodiments, a predetermined color image is obtained while the conveying operation of an ink sheet 1 is controlled. As clearly seen from FIGS. 8 and 9, when each of marks is detected by each of sensors $S_a$ and $S_b$ to obtain this predetermined color image, a leading end region of each of ink layers can reach a printing position, or a terminal end of the ink sheet 1 can be detected by setting values L, N, q, S and δ such that the following fourth formula is satisfied.

$$L=N\times q+S-\delta$$

In this fourth formula, L is set to a distance from the printing position X to each of the sensors $S_a$ and $S_b$. Value q is set to a pitch between the ink layers as a pitch between the marks. N is set to an integer equal to 2 or more. In FIGS. 8 and 9, N is set to 2. δ is set to an arbitrary value from 0 to 4 min. S is set to a distance from a detected position of each of the marks to a most leading end of each of the ink layers. In this example, a leading end edge of each of the marks is arranged in the detected position thereof. S is an arbitrary value from zero to the pitch q. In each of FIGS. 8 and 9, each of clearances P between the ink layers can be set to a suitable value including zero. Thus, the same recording operation as each of the above embodiments can be performed in the embodiments shown in FIGS. 8 and 9.

As can be seen from the above explanation, when the sensors $S_a$ and $S_b$ are arranged on a downstream side of the ink sheet in a conveying direction thereof from the printing position X, the above values L, q, S, etc. are determined such that the above third formula is satisfied. In contrast to this, when the sensors $S_a$ and $S_b$ are arranged on an upstream side of the ink sheet in the conveying direction from the printing position X, the above values L, q, S, etc. are determined such that the above fourth formula is satisfied.

Figure 10:
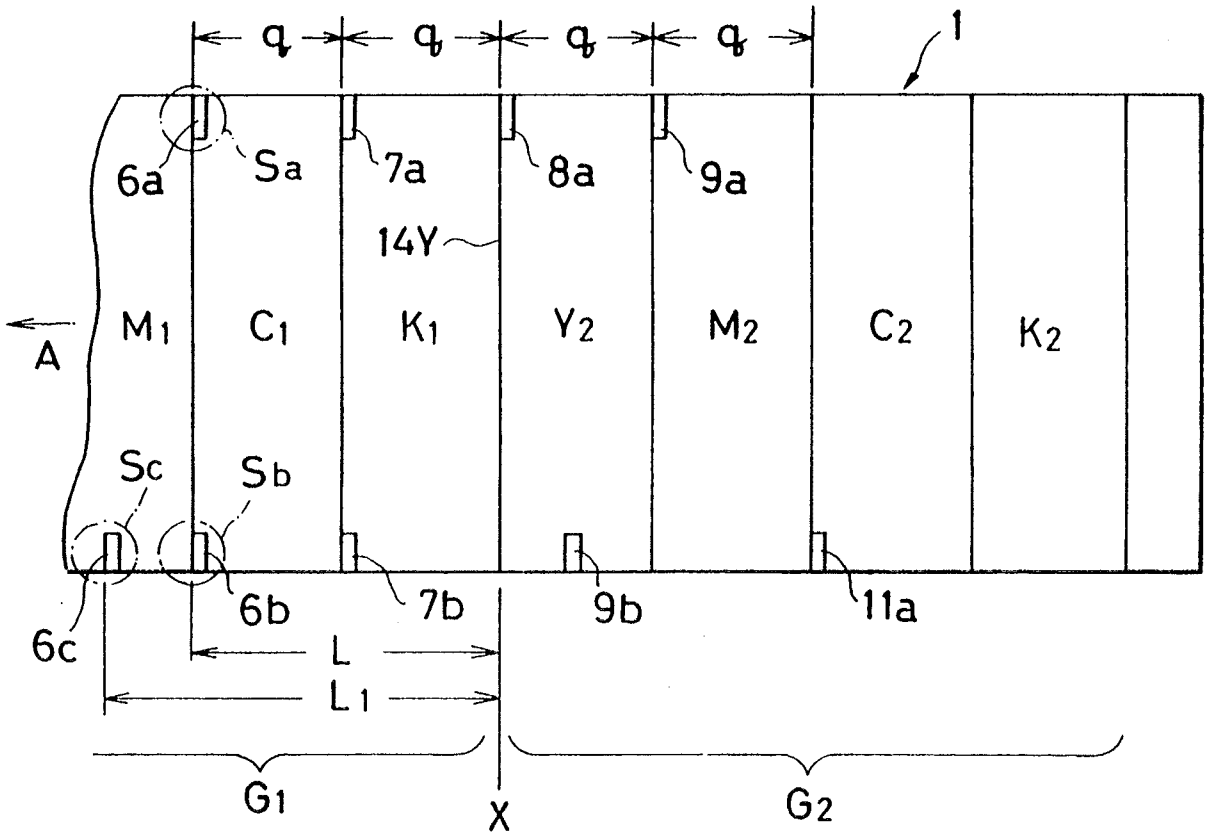
FIG. 10 is a plan view similar to FIG. 2 and showing another embodiment of the present invention.

In the color thermal transfer recorder of this kind, a color image can be obtained as mentioned above. If a monochromatic image can be also obtained in addition to the color image, it is possible to increase uses of the recorder. FIG. 10 is an explanatory view showing one example of a color thermal transfer recorder having a function for providing such monochromatic and color images.

In this example, similar to the embodiment shown in FIG. 2, first and second sensors $S_a$ and $S_b$ are arranged in positions separated from a printing position X by a distance L on the downstream side of an ink sheet in a conveying direction thereof. Further, another auxiliary sensor $S_c$ is fixedly arranged in a position separated from the printing position X in comparison with the first and second sensors $S_a$ and $S_b$. This sensor $S_c$ is also constructed by a photosensor of a reflecting type. An unillustrated reflecting plate similar to each of the reflecting plates 12 and 13 shown in FIG. 1 is arranged in a position opposite to this sensor $S_c$.

Each of marks is formed on the ink sheet 1 and is arranged as follows. Namely, a leading color mark is composed of two marks 6*a* and 6*b* located in both end portions of the ink sheet 1 in a width direction thereof. One auxiliary mark 6*c* is further formed on the downstream side of the ink sheet in the conveying direction thereof in comparison with the leading color mark. The auxiliary mark 6*c* is added to the leading color mark. The ink sheet 1 also has two heading marks 7*a* and 7*b* for a magenta ink layer $M_2$ and one heading mark 8*a* for a cyan ink layer $C_2$. The ink sheet 1 further has a heading mark 9*a* for a black ink layer $K_2$ and another auxiliary mark 9*b* located on the downstream side of the ink sheet in the conveying direction thereof in comparison with the heading mark 9*a*. The auxiliary mark 9*b* is added to the heading mark 9*a*. A terminal mark is constructed by one mark 11*a*.

Similar to the above embodiments, marks 6*a*, 6*b*, 7*a*, 7*b*, 8*a*, 9*a* and 11*a* except for the auxiliary marks 6*c* and 9*b* are arranged at the pitch q. The distance L from the printing position X to the first and second sensors $S_a$ and $S_b$ is also set such that the above third formula is satisfied. In the example shown in FIG. 10, δ and S are set to zero in the third formula and N as an integer equal to 2 or more is set to 2. In FIG. 10, clearances P between the ink layers are not formed, but may be formed.

In this example, when the two marks 6*a* and 6*b* are detected by each of the first and second sensors $S_a$ and $S_b$ and the auxiliary mark 6*c* is detected by the auxiliary sensor $S_c$, a leading end region of a color group $G_2$ is stopped in the printing position X. In this example, this leading end region is set to a most leading end 14Y of the color group $G_2$. From this stopping state, similar to the above embodiments, a printing operation is performed with respect to each of color ink layers $Y_2$, $M_2$, $C_2$ and $K_2$. Thus, similar to the above embodiments, a color image is formed on an image receiving paper sheet.

Figure 11:
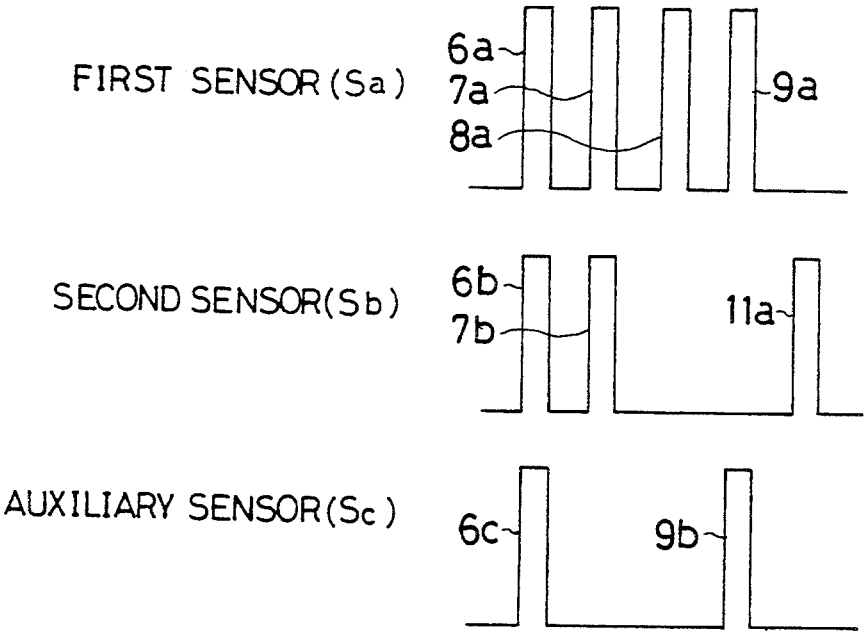
FIG. 11 is a timing chart showing operational timings of sensors shown in FIG. 10.

Namely, as shown in FIG. 11, when three sensors $S_a$, $S_b$ and $S_c$ respectively detect three marks 6*a*, 6*b* and 6*c*, a controller judges that the leading end region of the color group $G_2$ has reached the printing position X. When the first and second sensors $S_a$ and $S_b$ respectively detect two marks 7a and 7b, the controller judges that a leading end region of the magenta ink layer $M_2$ has reached the printing position X. Similarly, when the first sensor $S_a$ detects a mark 8a, the controller judges that a leading end region of the cyan ink layer $C_2$ has reached the printing position X. Further, when the sensors $S_a$ and $S_c$ respectively detect marks 9a and 9b, the controller judges that a leading end region of the black ink layer $K_2$ has reached the printing position X. When the second sensor $S_b$ detects a mark 11a, the controller judges that this detected mark shows a terminal end of the ink sheet 1. Then, the recorder displays that the ink sheet should be replaced with another.

Thus, detecting combinations of the marks detected by the three sensors $S_a$, $S_b$ and $S_c$ are different from each other. Therefore, it is possible to judge whether the leading end region of an ink layer of any color has reached the printing position X. Accordingly, as mentioned above, a color image can be obtained, and a monochromatic image can be also obtained.

For example, when an image of only magenta color is obtained, the image is formed on a sheet of image receiving paper by only the magenta ink layer $M_2$ from a detecting state in which the two marks 7a and 7b are detected by the first and second sensors $S_a$ and $S_b$. An image of only cyan color is obtained if the printing operation is started from a detecting state in which the mark 8a is detected by the first sensor $S_a$, and the image is formed on the paper sheet by only the cyan ink layer $C_2$. Thus, a monochromatic image of any color can be obtained and an overlapping image of two or three colors can be also obtained.

As mentioned above, in this embodiment, the recorder detects whether or not the leading end region of an ink layer of any color has reached the printing position X. Such a detecting operation is performed by using a detecting means having the first and second sensors $S_a$ and $S_b$ and at least one auxiliary sensor. This auxiliary sensor is set to $S_c$ in the example of FIG. 10. The auxiliary marks 6c and 9b detected by the auxiliary sensor $S_c$ are formed on the ink sheet 1. In this case, a pitch q of each of marks except for the auxiliary marks 6c and 9b, and a distance L from the printing position X to the first and second sensors $S_a$ and $S_b$ are also set such that the above third formula is satisfied. Accordingly, it is possible to arrange the sensors $S_a$ and $S_b$ such that these sensors are greatly separated from the printing position X.

Figure 12:
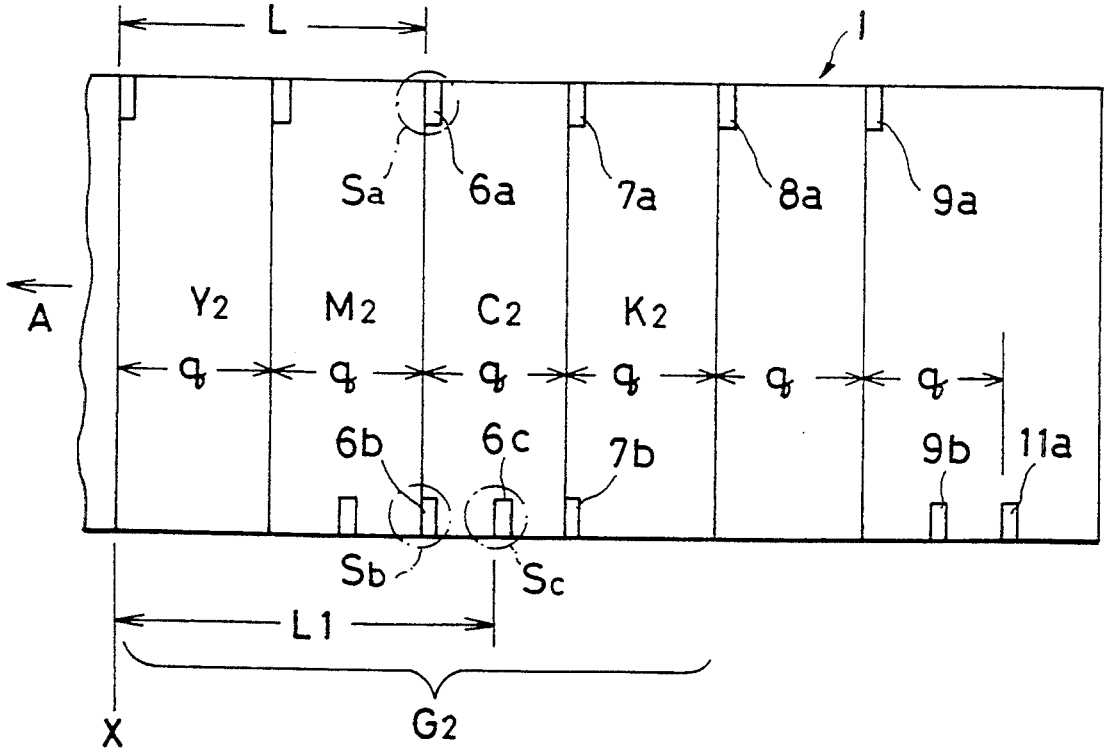
FIG. 12 is a plan view similar to FIG. 2 in accordance with another embodiment of the present invention.

In an embodiment shown in FIG. 12, first, second and third sensors $S_a$, $S_b$ and $S_c$ are arranged on the upstream side of an ink sheet in a conveying direction thereof from a printing position X. Similar to the embodiments shown in FIGS. 10 and 11, each of marks 6a, 6b, 6c, 7a, 7b, 8a, 9a, 9b and 11a is detected by each of the sensors $S_a$, $S_b$ and $S_c$. Further, in the embodiment shown in FIG. 12, the above-mentioned fourth formula is satisfied, and $\delta$ and S are set to zero and N as an integer equal to 2 or more is set to 2. In accordance with this construction, it is possible to perform the same recording operation as the embodiment shown in FIG. 10. Detecting states of the marks detected by the sensors $S_a$, $S_b$ and $S_c$ are similar to those in FIG. 11.

For example, in the embodiment shown in FIG. 10, after the ink sheet 1 is conveyed in the direction of an arrow A from a conveying state shown in FIG. 10, there is a fear of an error in operation of the recorder since no detecting timing shown in FIG. 11 can be obtained by detecting the mark 6b by the auxiliary sensor $S_c$ before the marks 7a and 7b are respectively detected by the first sensor $S_a$ and the second sensor $S_b$. Similarly, in the embodiment shown in FIG. 12, there is also a fear of an error in operation of the recorder caused by detecting the mark 7b by the auxiliary sensor $S_c$ before the marks 7a and 7b are respectively detected by the first and second sensors $S_a$ and $S_b$. There is further a fear of an error in operation of the recorder caused by detecting the mark 11a by the auxiliary sensor $S_c$ before this mark 11a is detected by the second sensor $S_b$.

For example, the following measures are taken to prevent such errors.

(1) In detection of a mark using each of the first and second sensors $S_a$ and $S_b$, no controller judges that this detected mark is a mark until the ink sheet 1 has moved by e.g., a distance corresponding to one pitch of an ink layer or a distance slightly shorter than this one pitch since each of the first and second sensors $S_a$ and $S_b$ detected this mark.

(2) The controller is constructed such that no unnecessary mark is judged as a mark when each of the sensors $S_a$, $S_b$ and $S_c$ detects the unnecessary mark. For example, when only the auxiliary sensor $S_c$ detects a mark, no controller judges that this detected mark is a mark. Otherwise, only when the auxiliary sensor $S_c$ and the first sensor $S_a$ detect a mark, the controller judges that this detected mark is a mark to be detected.

The above recording operation of the recorder can be also performed even when the auxiliary sensor $S_c$ in each of the embodiments shown in FIG. 10 and 12 is arranged in a position close to the printing position X in comparison with the first and second sensors $S_a$ and $S_b$. However, in such an arrangement, since the auxiliary sensor $S_c$ approaches the printing position X, it might be meaningless to arrange the first and second sensors $S_a$ and $S_b$ such that these sensors are greatly separated from the printing position X.

Therefore, in the embodiments shown in FIGS. 10 and 12, a distance $L_1$ from the printing position X to the auxiliary sensor $S_c$ is set to be greater than the distance L from the printing position X to the first and second sensors $S_a$ and $S_b$ so that all the sensors $S_a$ to $S_c$ are greatly separated from the printing position X. Such an arrangement prevents a degree of freedom in design of the recorder from being reduced. The distances $L_1$ and L may be set to be equal to each other. In this case, the auxiliary sensor $S_c$ is arranged in a position shifted from the first and second sensors $S_a$ and $S_b$ in a width direction of the ink sheet 1.

Figure 13:
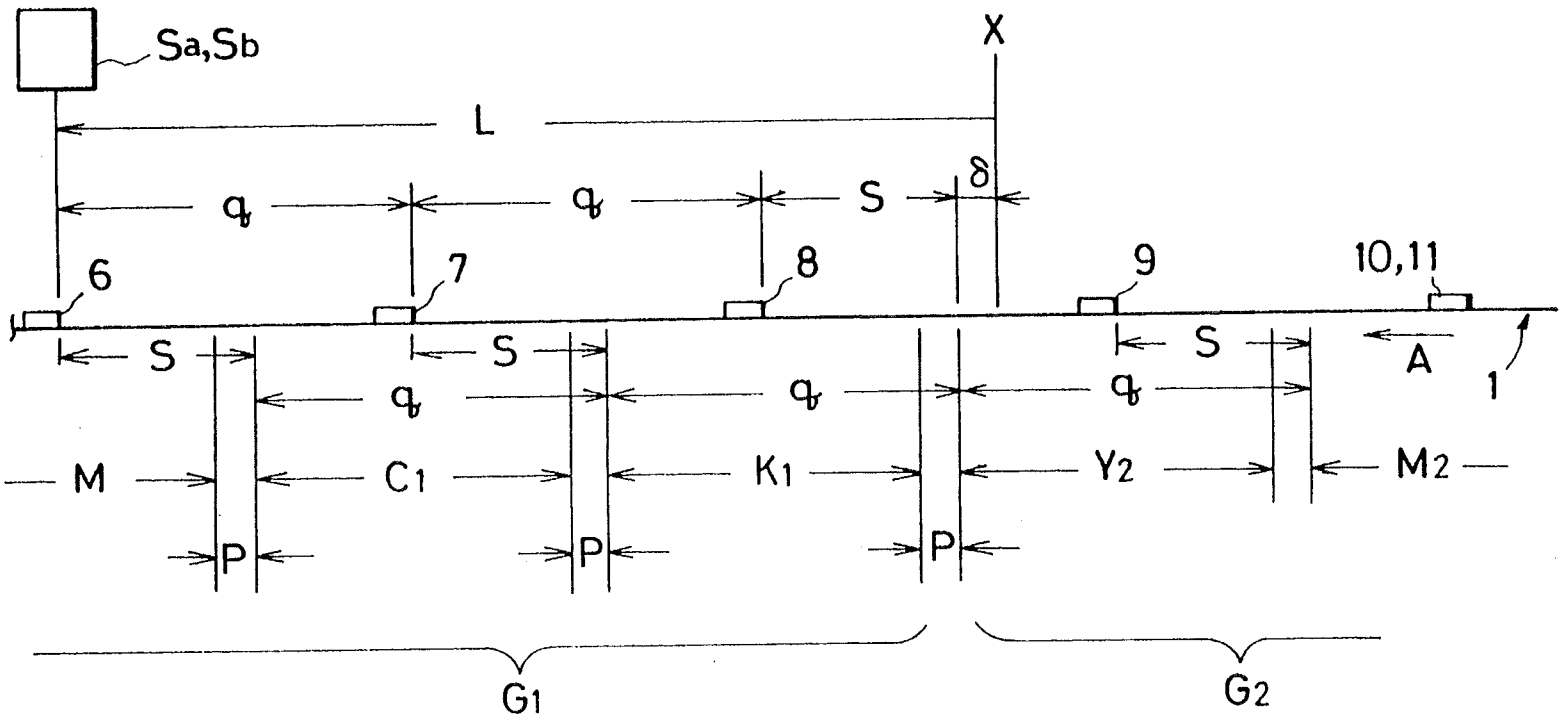
FIG. 13 is an explanatory view similar to FIG. 3 and showing another embodiment of the present invention.
Figure 14:
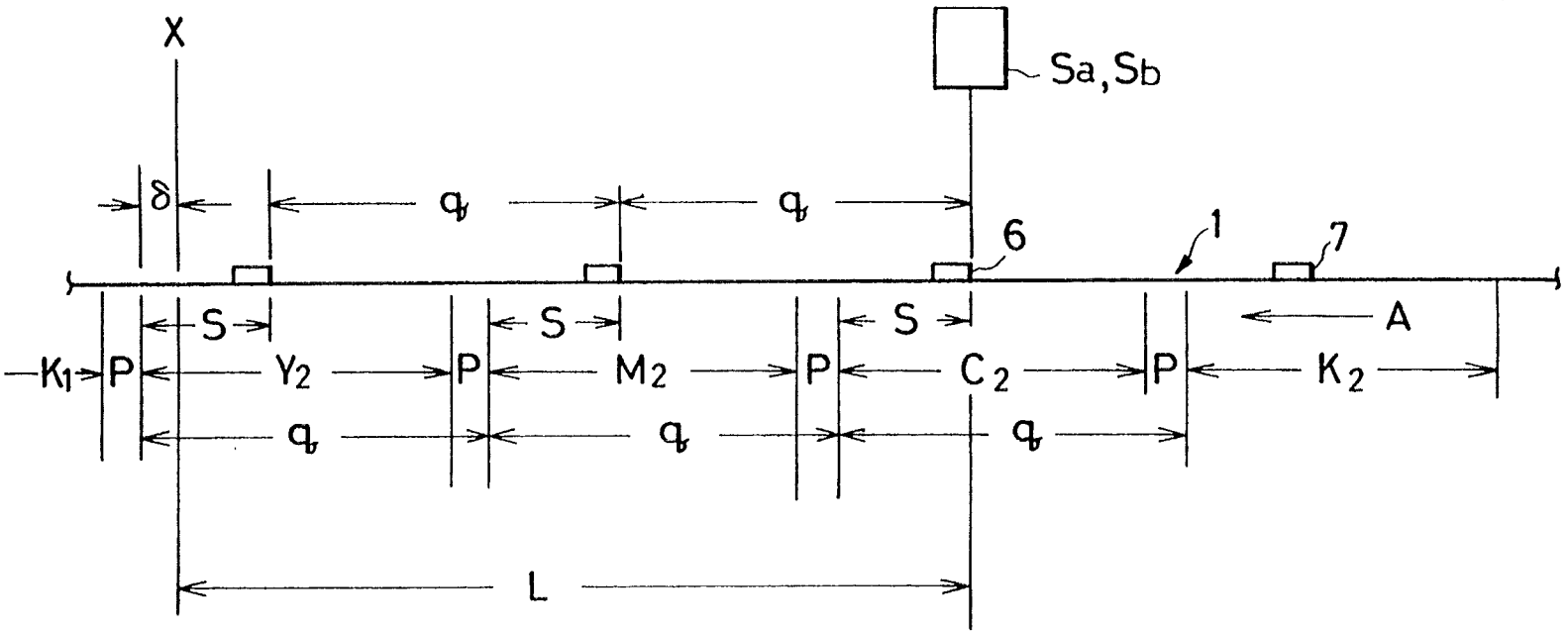
FIG. 14 is an explanatory view similar to FIG. 3 and showing another embodiment of the present invention.

In the above embodiments, each of marks is detected by each of the sensors at a leading end edge thereof. However, each of the marks may be detected by each of the sensors at a rear end edge thereof. FIGS. 13 and 14 show embodiments corresponding to those of FIGS. 7 and 9 when a rear edge detecting system for detecting a rear end edge of a mark is used. The construction of a color thermal transfer recorder in each of these embodiments is similar to that in each of the above embodiments and an explanation of this construction is therefore omitted in the following description.

The two sensors $S_a$ and $S_b$ are used in each of the embodiments shown in FIGS. 1 to 9 and FIGS. 13 and 14. In these embodiments, when these sensors $S_a$ and $S_b$ respectively detect the terminal marks 10 and 11, the controller judges that each of the terminal marks is a terminal end of the ink sheet. An output of the controller is then transmitted to a display section and this display section displays that the ink sheet should be replaced with another. At this time, there is a fear of an error in operation of the recorder when there are slight errors in arranging position of each of the sensors $S_a$ and $S_b$ and forming position of each of the marks.

Figure 15:
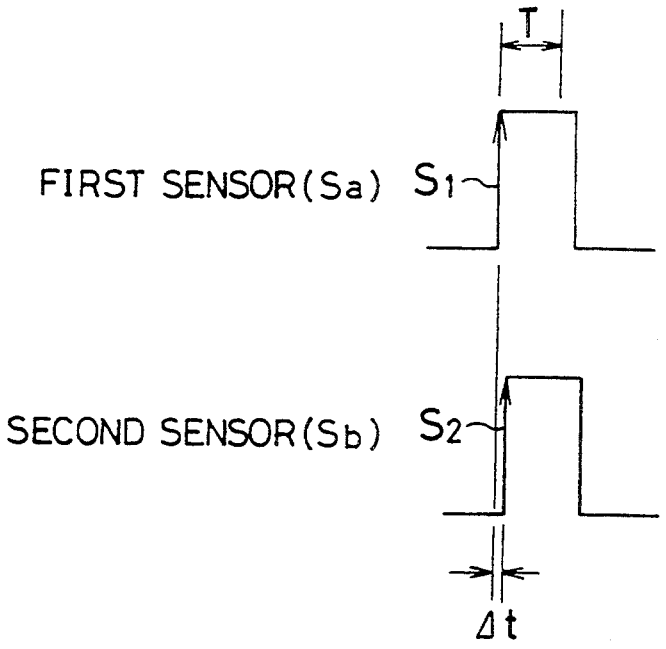
FIG. 15 is a view showing operating states of sensors.

In FIG. 15, the first and second sensors $S_a$ and $S_b$ are operated by terminal marks 10 and 11 and detect the terminal marks 10 and 11 by rising portions $S_1$ and $S_2$ of detecting pulses of these sensors. However, when the above errors are caused, a slight time difference $\Delta t$ is caused between rise times of the sensors $S_a$ and $S_b$. When such a time difference $\Delta t$ is caused and it is judged that each of the marks 10 and 11 has simultaneously reached each of the sensors $S_a$ and $S_b$ at the rise times of the sensors $S_a$ and $S_b$, the recorder judges that the first sensor $S_a$ has detected the leading color mark 6 although the first sensor $S_a$ actually detected the terminal mark 10. Accordingly, an error in operation of the recorder is caused. Such an error is similarly caused in each of the embodiments shown in FIGS. 10 to 12.

Therefore, in the embodiment shown in FIG. 15, for example, when the first sensor $S_a$ detects the mark 10 by its rising pulse portion $S_1$ and the second sensor $S_b$ then detects another mark 11 after a predetermined time of T seconds, the controller judges that the mark 11 is a terminal end of the ink sheet 1. Then, the controller performs a predetermined control operation based on this judgment. In this case, $T > \Delta t$ is set. In accordance with such a construction, each of the marks 10 and 11 can be correctly judged even when both the sensors $S_a$ and $S_b$ detect the marks 10 and 11 with the time difference $\Delta t$. When the first sensor $S_a$ detects a certain mark and no second sensor $S_b$ then detects this mark after T seconds, the controller judges that the first sensor $S_a$ has detected the leading color mark 6. Thus, a predetermined operation is next performed.

Figure 16:
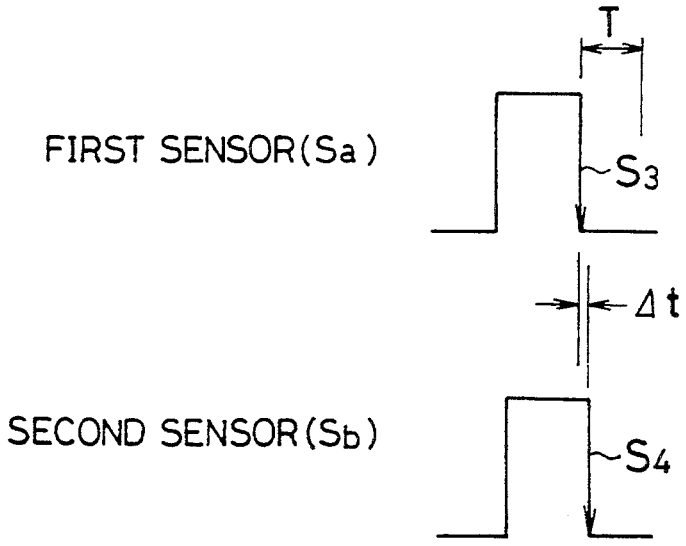
FIG. 16 is a view showing operating states of sensors.

FIG. 16 shows an example of rear edge detection in which both the sensors $S_a$ and $S_b$ detect a mark by falling pulse portions $S_3$ and $S_4$. In this case, for example, when the first sensor $S_a$ detects a certain mark by the falling pulse portion $S_3$ and the second sensor $S_b$ then detects another mark by the falling pulse portion $S_4$ after T seconds, the controller judges that these sensors $S_a$ and $S_b$ have detected the terminal end marks 10 and 11. In contrast to this, when no second sensor $S_b$ detects the above another mark after the T seconds, the controller judges that the first sensor $S_a$ has detected the leading color mark 6. Thus, there is no fear of an error in detection even when the time difference $\Delta t$ is caused for a falling period of each of the sensors $S_a$ and $S_b$. In this case, $T > \Delta t$ is set.

The above operations explained with reference to FIGS. 15 and 16 are similarly performed when the sensors $S_a$ and $S_b$ detect another mark and the sensors Sa, $S_b$ and $S_c$ shown in FIGS. 10 to 12 detect each of marks. After a predetermined time has passed since one sensor detected a mark, it is judged whether another sensor detects another mark or not. From this judgment, it is judged whether a leading end region of each of color groups reaches a printing position. It is also judged whether a leading end region of each of color ink layers except for a leading ink layer of each of the color groups reaches the printing position. Further, it is judged whether a detected mark is a terminal end of the ink sheet or not.

In each of the above embodiments, each of the marks is formed in an uncoated portion of the ink sheet 1 which is not coated with ink. However, each of the marks may be formed by forming a notch or hole in the ink sheet 1. In this structure, 100% of light is transmitted through each of the marks so that occurrence of an error in operation of a sensor can be prevented. Each of the marks can be also formed by coating the ink sheet with a high reflectivity portion such as a white portion for reflecting light from the sensor. In this structure, the reflecting plates 12 and 13 can be omitted. A shape of each of the marks can be suitably set. For example, each of the marks may be formed in a square shape, a rhombic shape, a circular shape, etc. in addition to the rectangular shape shown in the above embodiments.

For example, each of the marks can be arranged in a clearance between ink layers, etc. When each of the marks is formed in each of end portions of the ink sheet in a width direction thereof as in the above-mentioned embodiments, it is not necessary to form a large clearance for arranging each of the marks between the ink layers. Accordingly, it is possible to reduce an entire length of the ink sheet. Further, it is possible to prevent an uncoated region of ink from being formed by each of the marks between the ink layers. Accordingly, occurrence of wrinkles in the ink sheet can be prevented when the ink sheet is wound around a winding member.

In the above embodiments, an entire ink sheet portion except for the marks is coated with ink. Accordingly, the occurrence of wrinkles in the ink sheet can be also prevented when the ink sheet is wound around the winding member. The ink sheet can be formed such that each of the marks is formed by coating an outside region of each of the ink layers in the width direction of the ink sheet with ink and no sheet portion except for each of the marks in this outside region is coated with ink. In this case, an uncoated portion of ink having a large area is formed in both end portions of the ink sheet in the width direction thereof. Accordingly, when this ink sheet is wound, this uncoated portion of ink is formed with wrinkles. However, such problems are not caused in the above-mentioned embodiments of the present invention.

In accordance with first and second structures of the present invention, first and second sensors for detecting each of marks of an ink sheet can be arranged such that these sensors are greatly separated from a printing position. Accordingly, a degree of freedom in design of a color thermal transfer recorder can be increased without any problems.

In accordance with a third structure of the present invention, in addition to the above effects, a monochromatic image can be also formed on the ink sheet so that uses of the color thermal transfer recorder can be increased.

In accordance with a fourth structure of the present invention, an auxiliary sensor can be also arranged such that the auxiliary sensor is greatly separated from the printing position. Accordingly, the degree of freedom in design of the recorder can be increased.

In accordance with a fifth structure of the present invention, an error in detection of each of the sensors can be prevented.

Many widely different embodiments of the present invention may be constructed without departing from the spirit and scope of the present invention. It should be understood that the present invention is not limited to the specific embodiments described in the specification, except as defined in the appended claims.

What is claimed is:

1. A color thermal transfer recorder in which a plurality of ink layers having colors different from each other are arranged in a longitudinal direction of an ink sheet and are set to one set of color groups and the ink sheet is used by repeatedly forming the color groups in the longitudinal direction;

many heating elements of a thermal head are selectively heated while the ink sheet and a sheet of image receiving paper are supported between the thermal head and a platen and the ink sheet is conveyed in the longitudinal direction thereof at a speed lower than that of the image receiving paper sheet;

a color image is formed on the image receiving paper sheet by transferring ink of each of the ink layers of each of the color groups formed in the ink sheet onto the image receiving paper sheet;

said ink sheet has:

a leading color mark for detecting that a leading end region of each of the color groups reaches a printing position between the heating elements and the platen;

a heading mark for detecting that a leading end region of each of the color ink layers except for a leading ink layer of each of the color groups reaches said printing position; and a terminal end mark for detecting a terminal end of the ink sheet;

each of said marks is detected by detecting means constructed by first and second sensors;

said first and second sensors are arranged on a downstream side of the ink sheet in a conveying direction thereof from the printing position; and when L is set to a distance from the printing position to each of said first and second sensors, q is set to a pitch between said marks, N is set to an integer equal to 2 or more, S is set to an arbitrary value from zero to said pitch q, and $\delta$ is set to an arbitrary value from 0 to 4 mm, the values L, q, N, S and $\delta$ are set such that the following formula $$L=N\times q+S+\delta$$

is satisfied.

2. A color thermal transfer recorder as claimed in claim 1, wherein the detecting means has at least one auxiliary sensor in addition to said first and second sensors to detect that a leading end region of an ink layer of any color reaches said printing position; and an auxiliary mark detected by the auxiliary sensor is formed on the ink sheet.

3. A color thermal transfer recorder as claimed in any one of claims 1 and 2, wherein a distance from the printing position to the auxiliary sensor is set to be equal to or greater than a distance from the printing position to the first and second sensors, 4. A color thermal transfer recorder as claimed in any one of claims 1 and 2, wherein the leading end region of each of the color groups is judged to-reach the printing position, leading end region of each of the color ink layers except for the leading ink layer of each of the color groups is judged to reach the printing position, or the terminal end of the ink sheet is judged according to whether one sensor detects one mark and another sensor then detects another mark after a predetermined time.

5. A color thermal transfer recorder in which a plurality of ink layers having colors different from each other are arranged in a longitudinal direction of an ink sheet and are set to one set of color groups and the ink sheet is used by repeatedly forming the color groups in the longitudinal direction;

many heating elements of a thermal head are selectively heated while the ink sheet and a sheet of image receiving paper are supported between the thermal head and a platen and the ink sheet is conveyed in the longitudinal direction thereof at a speed lower than that of the image receiving paper sheet;

a color image is formed on the image receiving paper sheet by transferring ink of each of the ink layers of each of the color groups formed in the ink sheet onto the image receiving paper sheet;

said ink sheet has:

a leading color mark for detecting that a leading end region of each of the color groups reaches a printing position between the heating elements and the platen;

a heading mark for detecting that a leading end region of each of the color ink layers except for a leading ink layer of each of the color groups reaches said printing position; and a terminal end mark for detecting a terminal end of the ink sheet;

each of said marks is detected by detecting means constructed by first and second sensors;

said first and second sensors are arranged on an upstream side of the ink sheet in a conveying direction thereof from the printing position; and when L is set to a distance from the printing position to each of said first and second sensors, q is set to a pitch between said marks, N is set to art integer equal to 2 or more, S is set to an arbitrary value from zero to said pitch q, and $\delta$ is set to an arbitrary value from 0 to 4 mm, the values L, q, N, S and $\delta$ are set such that the following formula $$L=N\times q+S-\delta$$

is satisfied.

6. A color thermal transfer recorder as claimed in claim 5, wherein the detecting means has at least one auxiliary sensor in addition to said first and second sensors to detect that a leading end region of an ink layer of any color reaches said printing position; and an auxiliary mark detected by the auxiliary sensor is formed on the ink sheet.

7. A color thermal transfer recorder as claimed in any one of claims 5 and 6, wherein a distance from the printing position to the auxiliary sensor is set to be equal to or greater than a distance from the printing position to the first and second sensors.

8. A color thermal transfer recorder as claimed in any one of claims 5 and 6, wherein the leading end region of each of the color groups is judged to, reach the printing position, the leading end region of each of the color ink layers except for the leading ink layer of each of the color groups is judged to reach the printing position, or the terminal end of the ink sheet is judged according to whether one sensor detects one mark and another sensor then detects another mark after a predetermined time.

* * * * *